US008647415B1

(12) United States Patent
De Haan et al.

(10) Patent No.: US 8,647,415 B1
(45) Date of Patent: Feb. 11, 2014

(54) COKE CATCHER

(75) Inventors: Stephen De Haan, Wayne, NJ (US); Peter Kin-Lee Tam, Armonk, NY (US)

(73) Assignee: Lummus Technology Inc., Bloomfield, NJ (US)

( * ) Notice: Subject to any disclaimer, the term of this patent is extended or adjusted under 35 U.S.C. 154(b) by 0 days.

(21) Appl. No.: 13/554,460

(22) Filed: Jul. 20, 2012

(51) Int. Cl.
*B01D 45/00* (2006.01)

(52) U.S. Cl.
USPC ..... 95/267; 110/216

(58) Field of Classification Search
USPC ..... 95/267; 110/203, 216
See application file for complete search history.

(56) References Cited

U.S. PATENT DOCUMENTS

| | | | |
|---|---|---|---|
| 5,922,192 | A | 7/1999 | Zimmermann et al. |
| 2005/0261532 | A1 | 11/2005 | Stell et al. |
| 2007/0108036 | A1 | 5/2007 | Siskin et al. |
| 2009/0114567 | A1 | 5/2009 | Maxwell |
| 2011/0226667 | A1 | 9/2011 | Lott et al. |

FOREIGN PATENT DOCUMENTS

JP 2007198635 A * 8/2007

OTHER PUBLICATIONS

International Search Report and Written Opinion issued Oct. 18, 2013 in corresponding International application No. PCT/US2013/050013 (15 pages).

* cited by examiner

*Primary Examiner* — Robert A Hopkins
(74) *Attorney, Agent, or Firm* — Osha • Liang LLP

(57) ABSTRACT

The present disclosure provides for processes including a coke catcher that may be emptied during normal operation or steam standby, thereby overcoming the deficiencies in the prior design as discussed above, the coke catchers and process flows disclosed herein protecting the secondary transfer line exchanger from foulant while not limiting the time between heater cold shutdowns. The designs consider the impact of decoking options, such as when decoking to a firebox as opposed to a decoking drum. Further, flow and cost considerations are addressed in various embodiments; for example, decoke valves are fairly expensive, and process flows disclosed herein may provide for relocation of the decoke valve to facilitate coke catcher operations while not adding an expensive valve to the overall operating flow scheme.

5 Claims, 5 Drawing Sheets

COKE CATCHER

FIELD OF THE DISCLOSURE

Embodiments disclosed herein relate generally to a process for hydrocarbon cracking. More specifically, embodiments disclosed herein relate to systems and processes for cracking ethane, propane, and butane to produce ethylene and propylene, as well as the efficient maintenance of these systems during normal cracking operations and during periodic decoking of the system.

BACKGROUND

Cracking hydrocarbons from long chain molecules to gasoline and other useful short chain hydrocarbons, such as olefins, results in the production of significant secondary by-products of the reaction, most notably carbonaceous deposits or coke. The effects of the coke produced in the reaction are considerable, especially in fired tubular furnace reactors and the like utilizing process reactor tubes in which the cracking reaction occurs.

During the reaction, the coke by-products form deposits as a layer on the inside of the process tubes of the reactor. The coke deposits increase the pressure drop and inhibit heat transfer across the tubes thereby penalizing the process. The coke must therefore be removed periodically to restore the pressure drop and heat transfer to normal levels. The coke removal process, generally called decoking, is commonly carried out by combustion (also known as steam-air decoking) or by steam reaction.

Referring now to FIG. 1, a simplified process flow diagram of a prior art cracking process is illustrated. A fired tubular furnace 1 is used for cracking hydrocarbons to ethylene and other olefinic compounds. The fired tubular furnace 1 has a convection section 2 and a cracking section 3. The furnace 1 contains one or more process tubes 4 through which hydrocarbons fed through a hydrocarbon feed line 6 are cracked to produce product gases upon the application of heat, with carbonaceous deposits referred to herein as coke produced as a by-product. Steam may additionally be fed as a diluent, such as via flow line 7. Heat is supplied by a heating medium introduced to the exterior of the process tubes 4 in the cracking section 3 of the furnace 1 through heating medium inlets 8, such as hearth burners, floor burners, or wall burners, and exiting through an exhaust 10. After the feed is processed through the convection section 2 and the cracking section 3, the product gases flow through the product gas exit 12 and are then passed through one or more quench/heat exchangers 14 and 16, which are referred to herein as the primary transfer line exchanger 14 and the secondary transfer line exchanger 16. The product gases are then directed along line 18 to downstream processing equipment such as a quench tower and separation means (not shown).

During cracking operations, as noted above, coke may form on the process tubes 4. Valve 20 is positioned in the hydrocarbon feed line 6 to interrupt the hydrocarbon feed for decoking operations. After interruption of the hydrocarbon feed flow, steam and/or air from an air conduit 22 are injected to remove the coke buildup from process tubes 4.

During decoking, downstream valves 34, 36 control the direction of the effluent gas and coke spall away from the product separation system (not shown). When the hydrocarbon feed valve 20 is closed, the valve 34 to the downstream processing system (not shown) is also closed and a decoking effluent valve 36 is opened to direct the decoking effluent along an effluent line 38, such as to a decoking drum (not shown) or the firebox. As air cannot be introduced to the separation system, the valve 34 to the processing system is closed and the effluent valve 36 is opened to direct the effluent away from the separation system upon interruption of the hydrocarbon feed flow and introduction of air into the steam matrix for decoking.

Upsets or intentional changes in cracking conditions during normal operation can result in cooling and contraction of process tubes 4. This in turn can result in breaking off of coke or spalling. Spalling is also likely to occur when the furnace 1 is switched from normal cracking operation to decoking operation. The spalled coke can flow downstream and plug the tubes 42 of secondary transferline exchanger 16 and/or downstream processes. Depending on the specific design, the coke could enter the quench tower making oil/water separation more difficult or enter the firebox during decoking resulting in excessive particulate emissions from the heater stack.

Referring now to FIG. 2, a simplified process flow diagram of another prior art cracking process is illustrated, where like numerals represent like parts. As illustrated, the system includes a "coke catcher" 50 to minimize secondary transfer line exchanger plugging and coke contamination of the quench water system or firebox (not shown). The coke catcher 50 is located upstream of the secondary transfer line exchanger 16, where a change of direction of the effluent from the primary transfer line exchanger 14 causes the coke to continue straight into the coke catcher 50 while the effluent gas turns toward the secondary transfer line exchanger 16 via flow line 52. The coke catcher is essentially a length of pipe forming a "dead leg" in the heater outlet located after the primary transfer line exchanger 14 and before the secondary transfer line exchanger 16.

The coke catcher is located in the plant such that the coke can periodically be emptied and carted away for disposal. Unfortunately, the design as illustrated in FIG. 2 provides no means for isolating the coke catcher from the heater effluent, thus requiring the heater 1 to be taken out of service and cooled to clean out the coke catcher 50. Shutting down cold stresses heater parts and causes a loss in production. Additionally, sizing the coke catcher for an extended run length may require a very large volume, and leaving coke and potentially some tar in the coke catcher for such an extended period may result in an agglomerate that is difficult to remove.

SUMMARY OF THE CLAIMED EMBODIMENTS

The present disclosure provides for processes including a coke catcher that may be emptied during normal operation or steam standby, thereby overcoming the deficiencies in the prior design as discussed above, the coke catchers and process flows disclosed herein protecting the secondary transfer line exchanger from foulant while not limiting the time between heater cold shutdowns. The designs consider the impact of decoking options, such as when decoking to a firebox as opposed to a decoking drum. Further, flow and cost considerations are addressed in various embodiments; for example, decoke valves are fairly expensive, and process flows disclosed herein may provide for relocation of the decoke valve to facilitate coke catcher operations while not adding an expensive valve to the overall operating flow scheme.

In one aspect, embodiments disclosed herein relate to a process for reducing fouling, the process including: transferring a process stream from a continuous or semi-continuous process, the process stream comprising a gaseous fraction and a foulant fraction, through a flow conduit to a process device, wherein the flow conduit branches, causing (i) flow of the gaseous fraction to change direction before entering the process device and (ii) flow of the foulant fraction to continue into a foulant collection device or portion thereof; accumulating an amount of the foulant fraction in the foulant collection device or portion thereof; and isolating and emptying accumulated foulant fraction from the foulant collection device.

In another aspect, embodiments disclosed herein relate to a system for reducing fouling, the system including: a flow conduit for transferring a process stream from a continuous or semi-continuous process, the process stream comprising a gaseous fraction and a foulant fraction, through the flow conduit to a process device, a branch in the flow conduit, wherein the branch causes (i) flow of the gaseous fraction to change direction before entering the process device and (ii) flow of the foulant fraction to continue into a foulant collection device or portion thereof; the foulant collection device, wherein the foulant collection device has a volume for accumulating an amount of the foulant fraction in the foulant collection device; and means for isolating and emptying accumulated foulant fraction from the foulant collection device.

In another aspect, embodiments disclosed herein relate to a process for reducing heat exchanger fouling, the process including: cooling a process stream from a continuous or semi-continuous process in a first heat exchanger to form a cooled effluent comprising a gaseous fraction and a foulant fraction; transferring the cooled effluent through a flow conduit to a second heat exchanger, wherein the flow conduit branches, causing (i) flow of the gaseous fraction to change direction before entering the second heat exchanger and (ii) flow of the foulant fraction to continue into a foulant collection device; accumulating an amount of the foulant fraction in the foulant collection device or a first portion thereof; and isolating and emptying accumulated foulant fraction from the foulant collection device.

In another aspect, embodiments disclosed herein relate to a system for reducing heat exchanger fouling, the system including: a first heat exchanger for cooling a process stream from a continuous or semi-continuous process to form a cooled effluent comprising a gaseous fraction and a foulant fraction; a flow conduit for transferring the cooled effluent through to a second heat exchanger; a branch in the flow conduit, wherein the branch causes (i) flow of the gaseous fraction to change direction before entering the second heat exchanger and (ii) flow of the foulant fraction to continue into a foulant collection device; the foulant collection device, wherein the foulant collection device has a volume for accumulating an amount of the foulant fraction; and means for isolating and emptying accumulated foulant fraction from the foulant collection device.

In another aspect, embodiments disclosed herein relate to a process for producing olefins, the process including: during a cracking cycle, passing a hydrocarbon feed and optionally steam through a heat exchange tube in a radiant heating chamber of a heater at conditions to crack at least a portion of the hydrocarbon to form an effluent comprising olefins and byproducts including heavier hydrocarbons and coke; during a decoking cycle, passing at least one of nitrogen, steam, air, and oxygen through a heat exchange tube in a radiant heating chamber of a heater at conditions to decoke at least a portion of the heat exchange tube to form a decoke effluent; cooling the effluent or the decoke effluent in a primary transfer line exchanger to form a cooled effluent comprising a gaseous fraction and a foulant fraction; transferring the cooled effluent through a flow conduit to a secondary transfer line exchanger, wherein the flow conduit branches, causing (i) the flow of the gaseous fraction to change direction before entering the secondary transfer line exchanger, during at least the cracking cycle, and (ii) the flow of the foulant fraction to continue into a coke catcher; accumulating an amount of the foulant fraction in the coke catcher or a first portion thereof; and emptying accumulated foulant fraction from the coke catcher or a second portion thereof without shutting down the heater.

In another aspect, embodiments disclosed herein relate to a system for producing olefins, the system including: a heater; one or more heat exchange tubes for (a) during a cracking cycle, passing a hydrocarbon feed and optionally steam through a radiant heating chamber of the heater at conditions to crack at least a portion of the hydrocarbon to form an effluent comprising olefins and byproducts including heavier hydrocarbons and coke; (b) during a decoking cycle, passing at least one of nitrogen, steam, air, and oxygen through the radiant heating chamber of the heater at conditions to decoke at least a portion of the heat exchange tube to form a decoke effluent; a primary transfer line exchanger for cooling the effluent or the decoke effluent to form a cooled effluent comprising a gaseous fraction and a foulant fraction; a flow conduit for transferring the cooled effluent to a secondary transfer line exchanger; a branch in the flow conduit, wherein the branch causes (i) the flow of the gaseous fraction to change direction before entering the secondary transfer line exchanger, during at least the cracking cycle, and (ii) the flow of the foulant fraction to continue into a coke catcher; the coke catcher, wherein the coke catcher has one or more sections having a volume for accumulating an amount of the foulant fraction; and means for emptying accumulated foulant fraction from the coke catcher or a section thereof without shutting down the heater.

Other aspects and advantages will be apparent from the following description and the appended claims.

DETAILED DESCRIPTION

In one aspect, embodiments herein relate generally to a process for hydrocarbon cracking. More specifically, embodiments disclosed herein relate to systems and processes for cracking ethane and propane to produce ethylene and propylene, as well as the efficient maintenance of these systems during normal cracking operations and during periodic decoking of the system.

Overall, fouling of heat exchangers is a common problem within the petrochemical industry. As noted above, upsets or intentional changes in cracking conditions during normal operation can result in cooling and contraction of radiant section tubes, breaking off of coke or spalling, and flow of the coke or spalling downstream, plugging the secondary transferline exchanger and or downstream process.

Embodiments disclosed herein relate to a process for reducing heat exchanger fouling in continuous or semi-continuous processes. Additionally, embodiments disclosed herein may be useful for preventing fouling in other process equipment, such as pumps, valves, compressors, and other common equipment where unwanted buildup of foulants is undesirable or where the presence of solid components is unwanted. Finally, minimizing the amount of large coke particles that enter the firebox in the case of firebox decoking help to facilitate the complete burning of coke and reduce the heater stack emissions. In some embodiments, the foulant collection device may be isolated and emptied without discontinuing one or more portions of the continuous or semi-continuous process. In this manner, the foulant fraction does not get transported to the second heat exchange device. Additionally, the accumulated foulant may be emptied from the collection device on a periodic basis without the need to shut down process critical process operations, providing for continuity of operations or improved process aspects, such as reduced stresses, ease of restart, increased production, and other benefits as may be highlighted from the following embodiments related to hydrocarbon cracking processes.

Figure 3:
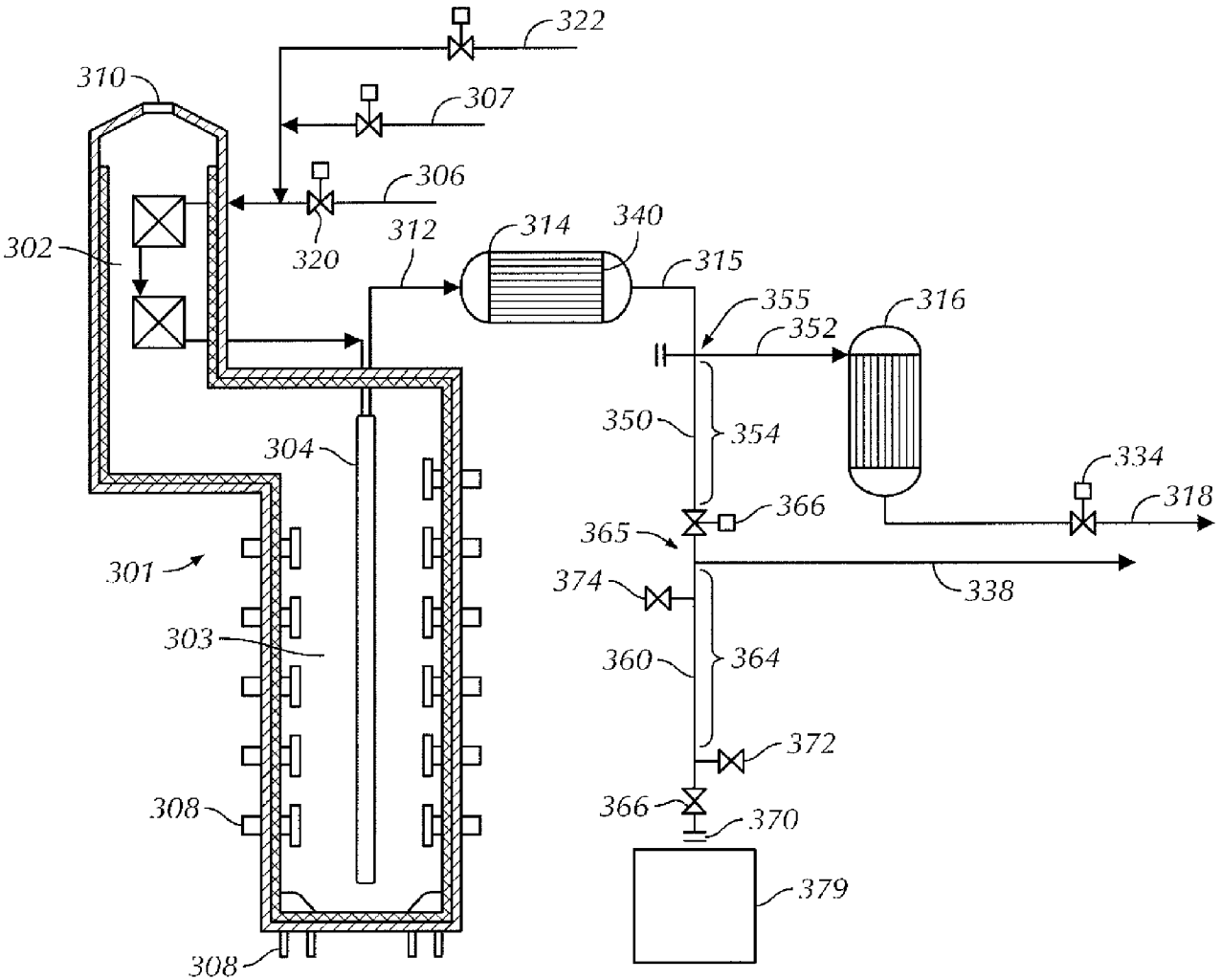
FIG. 3 is a simplified process flow diagram of a process for reducing heat exchanger fouling according to embodiments disclosed herein.

Referring now to FIG. 3, a simplified process flow diagram of one embodiment of a process for reducing heat exchanger fouling and or stack emissions during production of olefins is illustrated. A fired tubular furnace 301 is used for cracking hydrocarbons to ethylene and other olefinic compounds. The fired tubular furnace 301 has a convection section 302 and a cracking section 303. The furnace 301 contains one or more process tubes 304 through which hydrocarbons fed via hydrocarbon feed line 306, such as butane, propane and/or ethane, are cracked to produce product gases, such as ethylene and propylene, upon the application of heat. Other hydrocarbons, such as C5, C6 and heavier hydrocarbons may also be used to produce olefins according to other embodiments. During the cracking reactions, carbonaceous foulants such as coke and tars may be produced as a by-product. Steam may additionally be fed as a diluent, such as via flow line 307. Heat is supplied by a heating medium introduced to the exterior of the process tubes 304 in the cracking section 303 of the furnace 301 through heating medium inlets 308, such as hearth burners, floor burners, or wall burners, and exiting through an exhaust 310. After the feed is processed through the convection section 302 and the cracking section 303, the product gases flow through the product gas exit 312 and are then passed through one or more transfer line exchangers 314 and 316, which are referred to herein as the primary transfer line exchanger (PTLE 314) and the secondary transfer line exchanger (STLE 316). The product gases are then directed along line 318 to downstream processing equipment such as a quench tower and separation means (not shown).

During cracking operations, as noted above, coke may form on the process tubes 304. Valve 320 is positioned in the hydrocarbon feed line 306 to interrupt the hydrocarbon feed for decoking operations. After interruption of the hydrocarbon feed flow, steam and/or air from an air conduit 322 are injected to remove the coke buildup from process tubes 304.

During decoking, downstream valves 334, 336 control the direction of the effluent gas and coke spall away from the product separation system (not shown). When the hydrocarbon feed valve 320 is closed, the valve 334 to the downstream processing system (not shown) is also closed and a decoking effluent valve 336 is opened to direct the decoking effluent along an effluent line 338, such as to a decoking drum (not shown) or the firebox (such as via heating medium inlets 308 or an alternate combustion device). As air cannot be introduced to the separation system, the valve 334 to the processing system is closed and the effluent valve 336 is opened to direct the effluent away from the separation system upon interruption of the hydrocarbon feed flow and introduction of air into the steam matrix for decoking.

Upstream of STLE 316, transfer line 315 branches, with flow conduit 350 proceeding in the same general direction as flow in transfer line 315, and flow line 352 angling from transfer line 315. The general direction of flow conduits 350, 352 are such that the momentum of the stream carries the coke/foulants into conduit 350 while the product gases flow through conduit 352 and into STLE 316 for further cooling and feed to downstream operations (not shown).

During normal cracking operations, as noted above, valve 336 is normally closed. As illustrated in this embodiment, a first portion 354 of the coke catcher or dead leg may be considered as the volume of flow conduit 350 between branch point 355 and valve 336. This portion of the coke catcher may be sized to temporarily accumulate foulant carried into the coke catcher.

In some embodiments, the volume of the first portion 354 may be sized to collect an amount of coke/foulant produced during a single cracking cycle or a portion thereof. In other embodiments, the first portion may be sized for more than one cracking cycle, so as to accommodate for periods when coke make may be greater than expected or greater than during typical operations.

Dead leg portion 354 will be emptied into the remaining volume of the coke catcher via cycling of valve 336 during high steam standby prior to decoking. When the position of valves 334 and 336 are switched for decoking operations, the accumulated foulant then passes through valve 336 into flow conduit 360.

Similar to transfer line 315, flow conduit 350 branches, with flow conduit 360 proceeding in the same general direction as flow in transfer line 350, and flow line 338 angling from transfer line 350. The general direction of flow conduits 360 and 338 are such that the momentum of the stream carries the accumulated foulants and any solid components in the effluent during decoking into conduit 360 while the vaporous components of the decoking effluent recovered from PTLE 314 change direction and flow through conduit 338 to downstream operations (not shown), such as a decoking drum or a firebox.

As illustrated, during decoking operations, a second portion 364 of the coke catcher or dead leg may be considered as the volume of flow conduit 352 between branch point 365 and valve 366. This portion of the coke catcher may be sized to temporarily accumulate coke/foulant carried into the coke catcher, such as that produced over a single cracking and decoking cycle, or over multiple cracking and decoking cycles. The sizing of portions 354 and 364 should be such that coke/foulant is not carried into stream 338 or to the downstream operations, such as the aforementioned decoking drum or firebox.

The terminal portion 370 of the coke catcher may be located in the plant such that the accumulated coke/foulant can periodically be emptied and carted away for disposal, The bin 379, vessel, hopper, or structure into which the accumulated foulant is emptied may be movable, such as via wheels or forklift, and may be continuously located proximate the terminal portion 370, or may be temporarily placed for emptying when desired or necessary.

Coke catchers according to various embodiments disclosed herein may also include other valves, bulkheads, handholes, or other functional connections. For example, valve 372 may be provided as a steam supply inlet for purging any lighter hydrocarbons from the accumulated coke/foulant prior to discharge. As another example, valve 374 may be provided as a cooling water inlet to quench the accumulated foulant and provide a liquid environment to prevent exposure of potentially pyrophoric material to air. Other inlets and outlets may also be provided for nitrogen purge or sweep, cleaning, or other purposes. If desired or beneficial, one or more of the connections may be attached to the coke catcher using an angled connection to prevent buildup of foulant.

Figure 4:
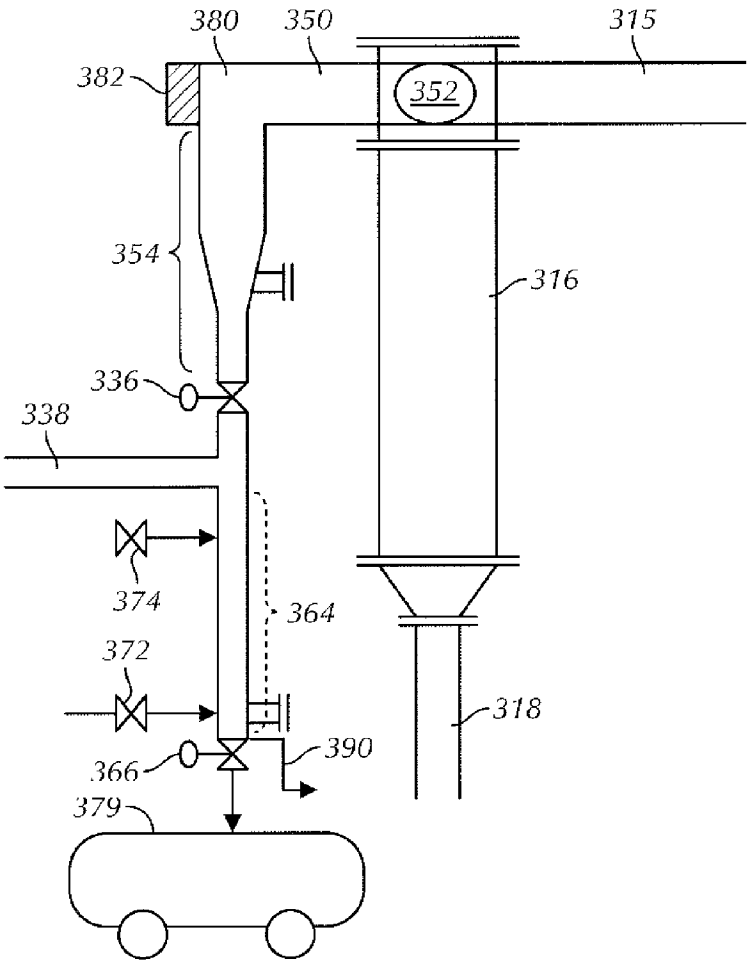
FIG. 4 is a simplified process flow diagram of a process for reducing heat exchanger fouling according to embodiments disclosed herein.

Referring now to FIG. 4, a simplified process flow diagram of one embodiment of a process for reducing heat exchanger fouling or stack emissions during production of olefins is illustrated, where like numerals represent like parts. In this embodiment, the effluent line 315 from the PTLE 314 traverses horizontally. The vapor phase effluent changes direction into branch line 352 and flows to the upper head of STLE 316. The momentum of the stream carries the foulant forward into branch line 350, effectively separating the foulant from the vapors and protecting STLE 316 from potential plugging.

It is desirable to accumulate foulant in a vertically oriented flow conduit to provide for ease in emptying. As branch line 350 is horizontal, a turn 380 may be provided to direct the foulant into portion 354 for accumulation during the operating cycle(s). In some embodiments, turn 380 may be provided by use of a piping elbow, tee, or similar connections. In other embodiments, turn 380 may be an elbow having an erosion barrier 382. In other embodiments, turn 380 may be provided by use of a tee, one leg of which may be filled with coke particles, a solid metal pad or other suitable materials to form erosion barrier 382. When turn 380 is a tee, the erosion barrier 382 may be integral with the remainder of the tee, or may be a removable plug or pad, so that the erosion barrier may be routinely replaced or repaired without the need to disassemble the entirety of turn 380.

In addition to the other valves mentioned above, FIG. 4 also includes a drain line 390, provided to remove water or other liquids that may settle in the coke catcher during normal operations, steam purging, or water cooling. As also illustrated in this embodiment, bin 379 may be any type of collection device, including open-type structures not requiring an air tight seal. This assumes that line 338 is feeding to a decoke drum, not a firebox. Thus, use of a decoke valve 336 may provide for positive isolation from the process streams, assuming no other heater is being decoked to the same decoke drum when the bottom valve 366 is opened to empty the foulant.

Figure 5:
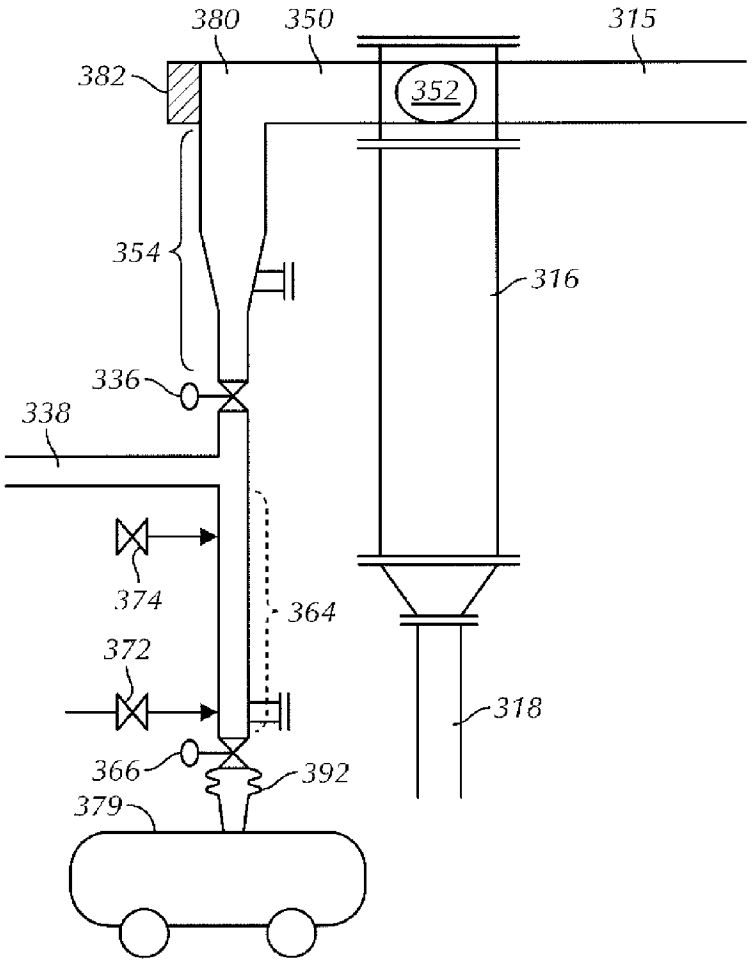
FIG. 5 is a simplified process flow diagram of a process for reducing heat exchanger fouling according to embodiments disclosed herein.

Referring now to FIG. 5, a simplified process flow diagram of one embodiment of a process for reducing heat exchanger fouling during production of olefins is illustrated, where like numerals represent like parts. In this embodiment, collection bin 379 is connected to valve 366 using a flexible type connection 392 or other connection means so as to provide an overall sealed system. As compared to the open-type emptying of coke/foulant in FIG. 4, the sealed system of FIG. 5 may provide greater protection against exposure to coke, benzene, or other chemical species. During filling (emptying of the coke catcher), the bin 379 is vented via flow line 338 to the decoke drum or the firebox. In addition to decreased potential for exposure, the embodiment illustrated in FIG. 5 may also be preferred when decoking to a firebox, as there is potential for the pressure in the firebox to exceed the downstream pressures, which may result in hot flue gases being pushed back through the decoke line.

As illustrated in the embodiments of FIGS. 3-5, combinations or obvious variants thereof, the decoke line 338 is incorporated into the coke catcher. The volume of the piping in the coke catcher below the decoke line 338 should be significant enough to provide for accumulation of coke/foulant without blocking the decoke line 338 itself. Thus, the time periods between emptying of the coke catcher necessarily depends upon the volume provided as well as the typical coke make during operations. A large volume or routine emptying may prevent blockage of the decoke line 338. Alternatively, a level measurement device may be provided such that the coke catcher may be routinely emptied before the accumulated level reaches the decoke line 338.

Figure 1:
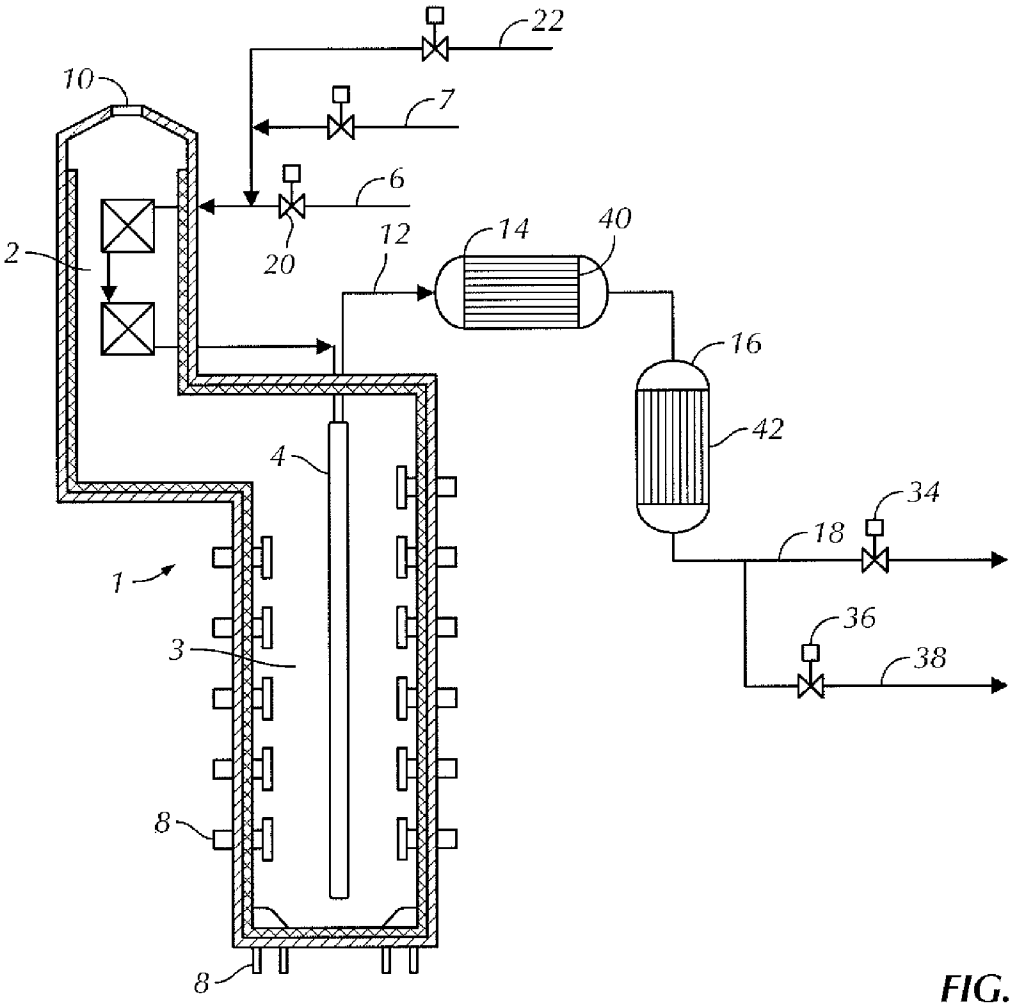
FIG. 1 (Prior Art)
FIG. 1 is a simplified process flow diagram of a prior art method for hydrocarbon cracking.
Figure 2:
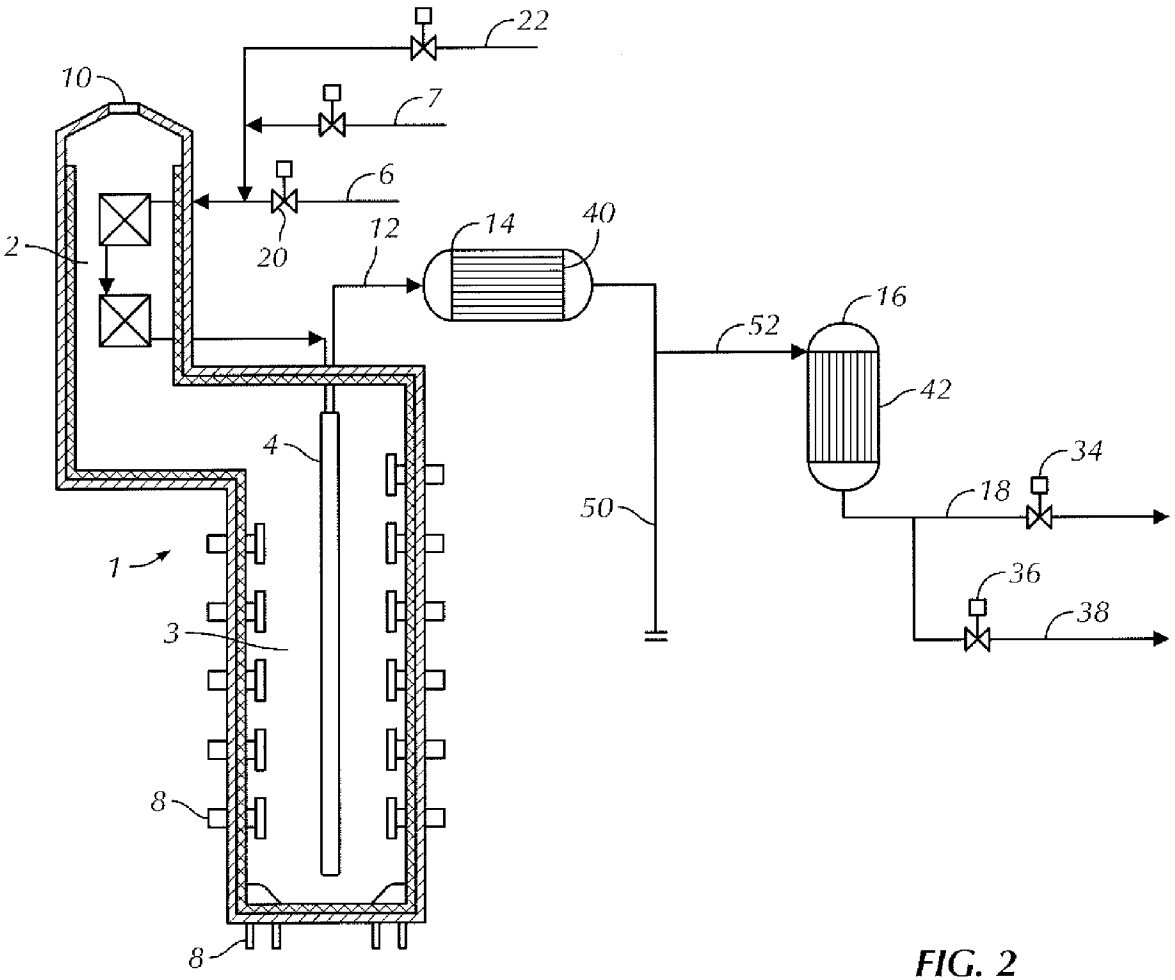
FIG. 2 (Prior Art)
FIG. 2 is a simplified process flow diagram of a prior art method for hydrocarbon cracking.

Also as a result of incorporation of the decoke line 338 into the coke catcher, the STLE is not decoked. While some buildup in the STLE may be removed during decoking as shown in the process of FIG. 1, it is anticipated that, using coke catchers according to embodiments illustrated in FIGS. 3-5 and disclosed herein, buildup in the STLE during normal operations may be significantly decreased, meaning that only periodic maintenance of the STLE may be needed, and which is routinely performed otherwise, even for the processes of FIG. 1 (e.g., no additional maintenance costs are anticipated when the decoke line is moved upstream of the STLE). As another difference, the STLE has flow on only one side during decoke operations. This may result in a minor loss of efficiency and heat recovery during decoking operations, as well as put stress on the STLE components. The minor efficiency losses may be offset by the improved operability of the overall system. Additionally, as the flow is maintained to the shell side, only tube-side process flows being interrupted, the additional stress on the STLE should be tolerable (within normal design criteria for the expected differential thermal expansion).

Figure 6:
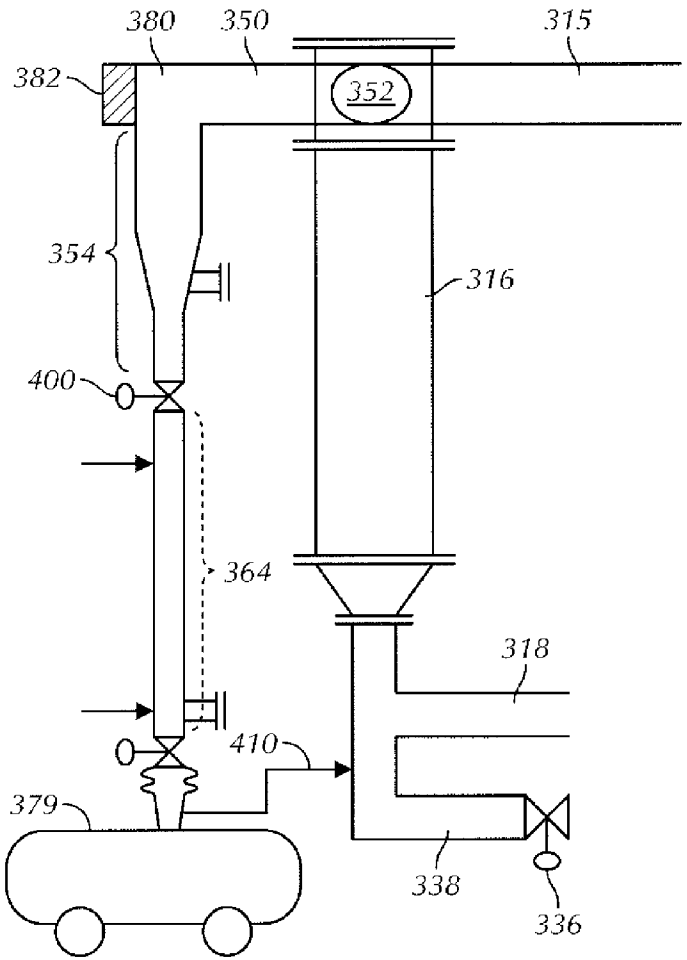
FIG. 6 is a simplified process flow diagram of a process for reducing heat exchanger fouling according to embodiments disclosed herein.

In some embodiments, it may be desirable to maintain the decoke line downstream of the STLE, such as to prevent the efficiency losses and stresses noted above. Referring now to FIG. 6, a simplified process flow diagram of one embodiment of a process for reducing heat exchanger fouling during production of olefins is illustrated, where like numerals represent like parts. In this embodiment, the decoke line 338 and decoke valve 336 are located downstream of STLE 316. The coke catcher is isolatable from the heater via valve 400, which may be a decoke type valve similar to the valve 336 used in the embodiments of FIGS. 3-5, so as to isolate the bottom portion 364 during emptying of the coke catcher. While this system may advantageously maintain heat recover efficiencies, it requires additional decoke valve(s), adding to the capital and maintenance costs of the overall system.

In FIG. 5 and described above, the decoke line provides for venting of vapor during emptying of the coke catcher into bin 379. In the embodiment of FIG. 6, a small vent line 410 may be provided between bin 379 and the decoke line to provide for venting during emptying of the coke catcher.

As described above, upsets or intentional changes in cracking conditions during normal operation can result in cooling and contraction of radiant section tubes. This in turn can result in breaking off of coke or spalling. Spalling is also likely to occur when the heater is switched from normal cracking operation to decoking operation. The spalled coke can flow downstream and plug the secondary transferline exchanger and or downstream process. Depending on the specific design, the coke could enter the quench tower making oil/water separation more difficult or enter the firebox during decoking resulting in excessive particulate emissions from the heater stack.

Advantageously, embodiments disclosed herein may provide for processes including a coke catcher that may be emptied during normal operation or steam standby. The coke catchers and process flows disclosed herein may protect the secondary transfer line exchangers from foulant while not limiting the time between heater cold shutdowns. The designs consider the impact of decoking options, such as when decoking to a firebox as opposed to a decoking drum. Further, flow and cost considerations are addressed in various embodiments; for example, decoke valves are fairly expensive, and process flows disclosed herein may provide for relocation of the decoke valve to facilitate coke catcher operations while not adding an expensive valve to the overall operating flow scheme. Additionally, embodiments disclosed herein may provide for reduced emissions by excluding a large portion of the coke from the firebox during firebox decoking.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A process for reducing fouling, the process comprising:

transferring a process stream from a continuous or semi-continuous process, the process stream comprising a gaseous fraction and a foulant fraction, through a flow conduit to a process device, wherein the flow conduit branches, causing (i) flow of the gaseous fraction to change direction before entering the process device and (ii) flow of the foulant fraction to continue into a foulant collection device or portion thereof;

accumulating an amount of the foulant fraction in the foulant collection device or portion thereof;

isolating and emptying accumulated foulant fraction from the foulant collection device; and wherein the process device comprises at least one of a pump, a heat exchanger, a valve, and a compressor.

2. The process of claim 1, wherein the isolating and emptying are performed without discontinuing one or more portions of the continuous or semi-continuous process.

3. A process for reducing heat exchanger fouling, the process comprising:

cooling a process stream from a continuous or semi-continuous process in a first heat exchanger to form a cooled effluent comprising a gaseous fraction and a foulant fraction;

transferring the cooled effluent through a flow conduit to a second heat exchanger, wherein the flow conduit branches, causing (i) flow of the gaseous fraction to change direction before entering the second heat exchanger and (ii) flow of the foulant fraction to continue into a foulant collection device;

accumulating an amount of the foulant fraction in the foulant collection device or a first portion thereof; and isolating and emptying accumulated foulant fraction from the foulant collection device.

4. The process of claim 3, wherein the isolating and emptying are performed without discontinuing one or more portions of the continuous or semi-continuous process.

5. The process of claim 3, wherein the accumulating step comprises accumulating an amount of the foulant fraction in a first portion of the foulant collection device, the process further comprising:

transporting the accumulated foulant to a second portion of the foulant collection device;

wherein the isolating step comprises isolating the first portion of the foulant collection device from the second portion of the foulant collection device.

* * * * *